United States Patent [19]

Knapp, Jr.

[11] 4,053,861

[45] Oct. 11, 1977

[54] ELECTRIC TIME-LAG FUSE HAVING A SMALL CURRENT RATING

[75] Inventor: Edward J. Knapp, Jr., Merrimac, Mass.

[73] Assignee: Gould, Inc., Newburyport, Mass.

[21] Appl. No.: 739,955

[22] Filed: Nov. 8, 1976

[51] Int. Cl.[2] ..... H01H 71/20

[52] U.S. Cl. ..... 337/165; 337/292; 337/297

[58] Field of Search ..... 337/163, 165, 166, 286, 337/292, 295, 297, 404

[56] References Cited

U.S. PATENT DOCUMENTS

| | | | |
|---|---|---|---|
| 2,354,111 | 7/1944 | Gardenhour | 337/404 |
| 2,667,551 | 1/1954 | Berthel | 337/166 |
| 2,683,788 | 7/1954 | Von Hoorn | 337/166 |
| 3,638,083 | 1/1972 | Dornfeld et al. | 337/297 X |

*Primary Examiner*—George Harris
*Attorney, Agent, or Firm*—Erwin Salzer

[57] ABSTRACT

A narrow strip of metal-clad material, as used in printed circuitry, is placed inside the casing of a fuse taking the place of the fusible conductor or element. The metal layer is, in part, removed from the strip by etching, or otherwise, leaving a central zone which is completely bare and two axially outer zones where the metal layer is substantially I-shaped. The axially inner ends of this I-shaped metal overlay are conductively interconnected by a spring-biased shorting strip which shorts said completely bare zone. The shorting strip is attached by soft solder to the axially inner ends of the I-shaped overlays and is spring-biased to a circuit interrupting position. The axially outer ends of the I-shaped overlays are connected by blind solder joints to terminal caps mounted on the ends of the casing of the fuse.

4 Claims, 5 Drawing Figures

ELECTRIC TIME-LAG FUSE HAVING A SMALL CURRENT RATING

BACKGROUND OF THE INVENTION

Fuses for small current ratings, e.g.20A, call for fusible elements which consist generally of wires having a small diameter, e.g.in the order of 0.01 inches. Such wires are extremely difficult to handle, requiring microscopes, micropositioners, etc., and highly skilled labor.

It is one object of this invention to provide fuses for current ratings of the above order which are simple to manufacture. Another object of the present invention is to provide fuses which can be manufactured by printed circuit techniques. Still another object of this invention is to provide time-lag fuses for current ratings of the above order which are simple to manufacture.

SUMMARY OF THE INVENTION

A fuse embodying this invention includes an elongated metal clad strip of electric insulating material wherein the metal layer is removed from the center region of the strip to define an insulating gap. The axially outer regions of said metal layer immediately adjacent said insulating gap are of relatively large width, and the axially outer regions of said metal layer more remote from said gap are of relatively narrow width. A shorting strip of sheet metal conductively interconnects said axially outer regions of said metal layer immediately adjacent said gap. This conductive connection is effected by a pair of soft solder joints. A helical spring having one end attached to said shorting strip biases said shorting strip to a circuit-open position which involves a pair of breaks, one on the locus of each solder joint. Said helical spring is shortened by said regions of said metal layer of relatively narrow width.

DESCRIPTION OF PREFERRED EMBODIMENT

Figure 1:
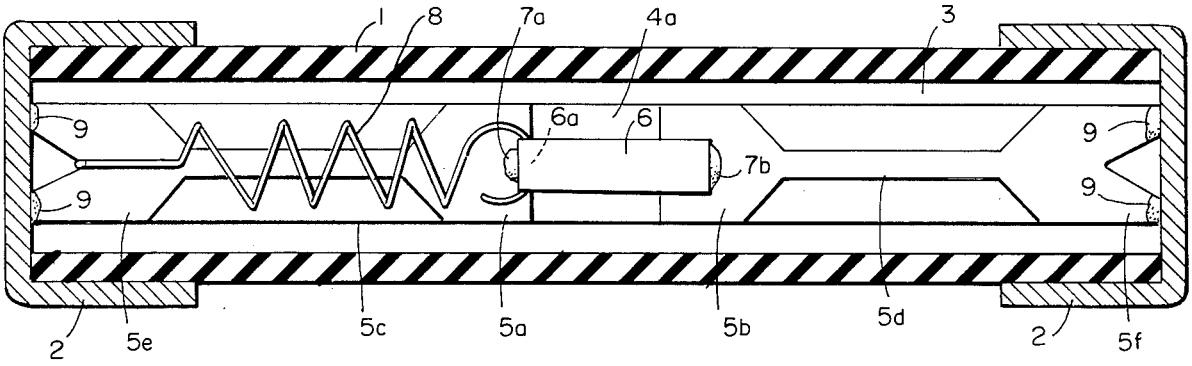
FIG. 1 is substantially a longitudinal section of a fuse embodying the present invention.
Figure 2:
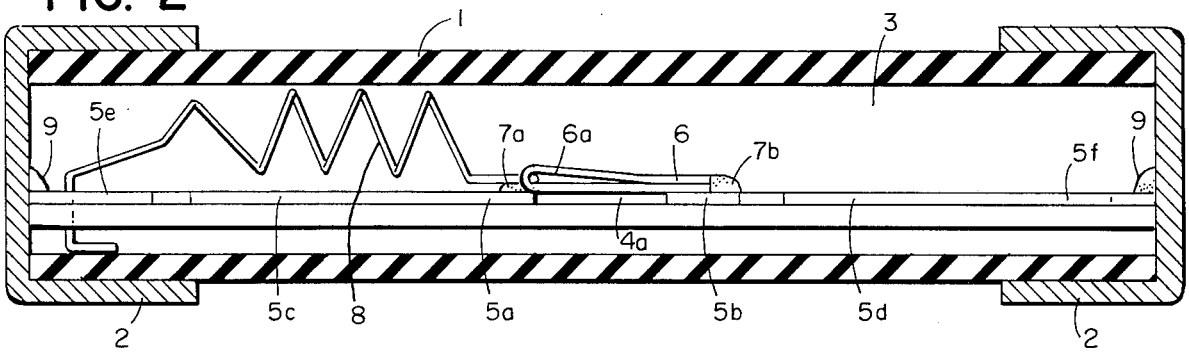
FIG. 2 is another substantially longitudinal section of a fuse embodying the present invention, taken along a plane at 90° to the plane of FIG. 1.
Figure 3A:
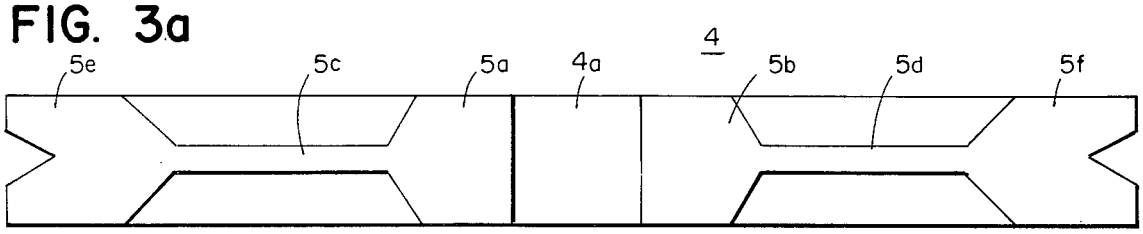
FIGS. 3*a* and 3*b* are a top-plan view and an elevational view of the metal clad part thereof.
Figure 3B:
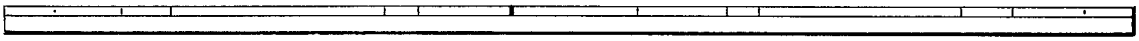
Figure 4:
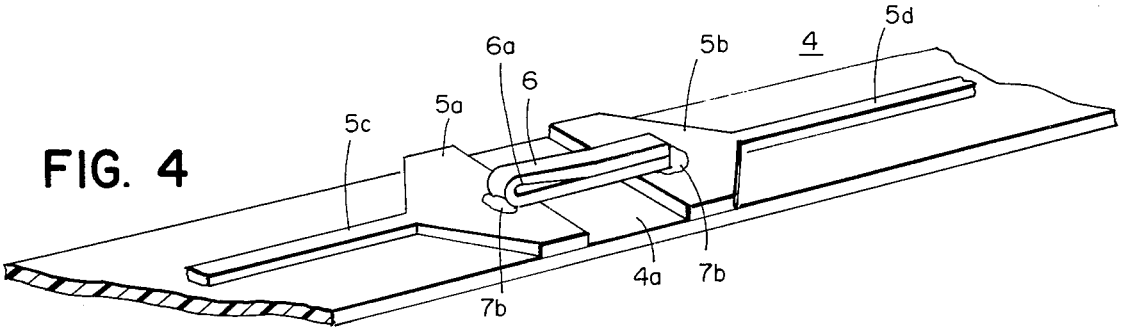
FIG. 4 is an isometric view of the central portion of the device of FIGS. 1 and 2.

Referring now to the drawings, reference numeral 1 has been applied to indicate a tubular casing of electric insulating material closed at both ends by terminal caps or ferrules 2. An elongated metal clad strip of electric insulating material, generally indicated at 4, is arranged inside of casing 1. Strip 4 is surrounded by air spaces 3. The metal layer on strip 4 is removed in the center region of the strip to define an insulating gap 4*a*. The axially outer regions of the metal layer immediately adjacent gap 4*a* are of relatively large width. Reference characters 5*a*, 5*b* have been applied to indicate these regions. The axially outer regions of the metal layer more remote from gap 4 are of relatively narrow width. Reference characters 5*c*,5*d* have been applied to indicate these regions. The metal layer at the axially outer ends of strip 4 is larger than regions 5*c*,5*d*. Reference characters 5*e*,5*f* have been applied to indicate these regions. It will thus be apparent that regions 5*a*,5*c*,5*e* and regions 5*b*,5*d*,5*f* form two substantially I-shaped metal layers which are separated by the insulating gap 4*a*. A shorting strip or bridge 6 of sheet metal conductively interconnects the regions 5*a* and 5*b*. Bridge 6 forms a loop closed at the right end thereof and forming a gap 6*a* at the left end thereof. Two soft solder joints 7*a* and 7*b* effect the conductive connection between bridge 6 and the metal overlay portions 5*a* and 5*b*, respectively. Reference numeral 8 has been applied to indicate a helical extension spring the right end of which is circular and inserted into the gap 6*a* formed by bridge 6. The overlay portion 5*e* is provided with a V-shaped cut-out into which the left hook-shaped end of helical spring 8 is inserted. Thus shorting bridge 6 is spring-biased to a circuit-open position, i.e. a position in which it does not conductively interconnect overlays 5*a* and 5*b* of strip 4.

The terminal caps 2 on casing 1 must be conductively connected with overlay areas 5*e* and 5*f* of strip 4. This is preferably achieved by the two blind solder joints 9 indicated in the drawing.

It will be apparent from the foregoing that the two large areas 5*a*,5*b* achieve the function of lag-blocks which impart to the fuse its time-lag characteristic. Overlay portions 5*c* and 5*e* serve as conductors to the lag-blocks. They may have the dimension in the order of 0.00I × 0.050 inches. The portions 5*e* and 5*f* of the overlay function as terminal tabs and are enlarged to allow to make good blind solder connection between them and terminal caps or ferrules 2.

I claim as my invention:

1. An electric time lag fuse including a. an elongated metal clad strip of electric insulating material wherein the metal layer is removed from the center region of the strip to define an insulating gap, wherein the axially outer regions of said metal layer immediately adjacent said gap are of relatively large width and the axially outer regions of said metal layer more remote from said gap are relatively narrow width;

b. a shorting strip of sheet metal conductively interconnecting said axially outer regions of said metal layer immediately adjacent said gap;

c. a pair of soft solder joints effecting said conductive connection; and d. a helical spring having one end attached to said shorting strip to bias said shorting strip to a circuit-open position thereof involving a pair of series breaks, said helical spring being normally shunted by one of said axially outer regions of said metal layer.

2. An electric fuse as specified in claim 1 wherein said metal clad strip and said shorting strip are arranged in a tubular casing, wherein the metal layer at the axially outer ends of said strip is larger than said axially outer regions thereof of a relatively small width, and wherein said axially outer ends are connected by blind solder joints to terminal caps mounted on said casing.

3. An electric fuse including a. a tubular casing of electric insulating material;

b. a pair of terminal caps closing the ends of said casing;

c. an elongated metal clad strip of insulating material wherein the metal layer is removed in the center of said strip and along the sides of said strip so that the metal remaining on said strip takes the form of two separate substantially I-shaped layers;

d. a shorting strip of sheet metal conductively interconnecting the axially inner ends of said substantially I-shaped layers;

e. a pair of soft solder joints effecting said conductive connection;

f. a helical shorting strip-biasing-spring tending to dislodge said shorting strip to interrupt the circuit controlled by said fuse at two points thereof, said spring being normally shunted by one of said substantially I-shaped layers; and g. a pair of solder joints conductively connecting the inside of said terminal caps to the axially outer ends of said substantially I-shaped layers.

4. An electric time lag fuse including a. a substantially tubular casing of electric insulating material;

b. a pair of terminal caps closing the ends of said casing;

c. an elongated partially metal clad strip of electric insulating material inside said casing, said strip having a center area where the metal layer is entirely removed so as to form an insulating gap, the remaining metal clad areas including two relatively large areas, one to each side of said insulating gap, forming lag-blocks, two relatively large areas at the axially outer ends of said strip forming solder tabs, and two relatively narrow areas conductively interconnecting said lag-blocks and said solder tabs;

d. a bridge conductively interconnecting said lag-blocks;

e. a pair of soft solder joints conductively attaching said bridge to said lag-blocks;

f. a helical bridge biasing spring tending to displace said bridge, said spring being normally shunted by one of said relatively narrow areas of said metal clad strip; and g. a pair of solder joints inside said casing conductively interconnecting said solder tabs and said terminal caps.

* * * * *